US009066569B2

(12) United States Patent
Durham et al.

(10) Patent No.: US 9,066,569 B2
(45) Date of Patent: Jun. 30, 2015

(54) APPARATUSES, METHODS AND SYSTEMS FOR REMOVING ELASTIC BANDS FROM HAIR

(71) Applicant: Durham Enterprises Corporation, Salt Lake City, UT (US)

(72) Inventors: Benjamin J. Durham, South Jordan, UT (US); Mark P. Durham, Salt Lake City, UT (US)

(73) Assignee: Durham Enterprises Corporation, Salt Lake City, UT (US)

( * ) Notice: Subject to any disclaimer, the term of this patent is extended or adjusted under 35 U.S.C. 154(b) by 0 days.

(21) Appl. No.: 13/913,366

(22) Filed: Jun. 7, 2013

(65) Prior Publication Data

US 2013/0327349 A1 Dec. 12, 2013

Related U.S. Application Data

(60) Provisional application No. 61/656,864, filed on Jun. 7, 2012.

(51) Int. Cl.
*A45D 24/00* (2006.01)
*A45D 44/00* (2006.01)
(Continued)

(52) U.S. Cl.
CPC ..... *A45D 24/00* (2013.01); *A45D 24/36* (2013.01); *A45D 44/00* (2013.01); *A45D 8/00* (2013.01); *A45D 8/36* (2013.01); *A45D 24/10* (2013.01); *A45D 2008/002* (2013.01)

(58) Field of Classification Search
CPC ..... A45D 24/00; A45D 24/36; A45D 24/10; A45D 2007/005; A45D 44/00; A45D 8/00; A45D 8/36; A45D 2008/002; B26B 21/42; B26B 13/24
USPC ..... 132/148, 212, 213, 213.1, 219, 147, 132/150, 333, 275, 104, 155, 73.5, 75.3, 132/75.4, 149, 200; 7/158, 160, 161, 162, 7/170, 134–136; D3/18; D28/10, 21, 22, D28/25, 30, 31, 99; 30/233.5, DIG. 8; 83/908, 910; 119/600, 610, 611, 613, 119/614, 625; 225/91, 93; D4/116; 15/105, 15/105.53; 606/138
See application file for complete search history.

(56) References Cited

U.S. PATENT DOCUMENTS 332,030 A * 12/1885 Young ..... 30/233.5
464,141 A * 12/1891 Low ..... 7/161
(Continued)

FOREIGN PATENT DOCUMENTS

CN 201528778 U * 7/2010

OTHER PUBLICATIONS

Removing Rubber Bands: Some Tools and Tricks, www.chocolatehairvanillacare.com (Nov. 5, 2010).*
(Continued)

*Primary Examiner* — Vanitha Elgart
(74) *Attorney, Agent, or Firm* — Durham Jones & Pinegar, P.C., Intellectual Property Law Group

(57) ABSTRACT

An elastic band removal apparatus includes a cutting element for removing elastic bands from hair. The cutting element may include a grasping element and an adjacent receptacle that are configured to engage a portion of an elastic band, as well as a severing edge configured to apply a localized pressure to the portion of the elastic band to cut or break the elastic band. The elastic band removal apparatus may comprise a comb, with the cutting element being carried by a spine of the comb, at or near an end of the comb. Methods for removing elastic bands from hair may include the use of such an elastic band removal apparatus. A grooming kit may include an elastic band removal apparatus, one or more elastic bands and a package for carrying the elastic band removal apparatus and the one or more elastic bands.

19 Claims, 3 Drawing Sheets

(51) Int. Cl.

| | |
|---|---|
| ***A45D 24/10*** | (2006.01) |
| ***A45D 7/02*** | (2006.01) |
| ***A45D 24/34*** | (2006.01) |
| ***A45D 24/36*** | (2006.01) |
| ***A45D 8/00*** | (2006.01) |
| *A45D 8/36* | (2006.01) |

(56) References Cited

U.S. PATENT DOCUMENTS

| | | | | | |
|---|---|---|---|---|---|
| D32,774 | S | * | 6/1900 | Maloney | D28/25 |
| 716,454 | A | * | 12/1902 | Martin | 7/136 |
| 995,194 | A | * | 6/1911 | Stegemann | 30/112 |
| 1,190,182 | A | * | 7/1916 | McDonough | 30/30 |
| D53,260 | S | * | 4/1919 | Von Tobel | D8/17 |
| 1,372,609 | A | * | 3/1921 | De Echevarria | 30/34.05 |
| 1,440,015 | A | * | 12/1922 | Kaniefski | 132/148 |
| 1,726,390 | A | * | 8/1929 | Erhard et al. | 7/136 |
| 1,731,287 | A | * | 10/1929 | Barnowitz | 132/102 |
| 1,891,303 | A | * | 12/1932 | Cazes et al. | 132/146 |
| 2,105,571 | A | * | 1/1938 | Williams | 132/122 |
| 2,288,299 | A | * | 6/1942 | Pileggi | 30/30 |
| 2,364,294 | A | * | 12/1944 | Hutaff, Jr. | 132/104 |
| 2,489,168 | A | * | 11/1949 | Tuck | 30/233.5 |
| 2,589,230 | A | * | 3/1952 | Davis et al. | 30/30 |
| 2,638,907 | A | * | 5/1953 | Boyer | 132/148 |
| 2,677,179 | A | * | 5/1954 | Servilla | 30/256 |
| 2,696,043 | A | * | 12/1954 | Maze | 30/233.5 |
| 2,785,688 | A | * | 3/1957 | Chester | 132/210 |
| 2,830,600 | A | * | 4/1958 | Churchillo | 132/213.1 |
| 2,849,793 | A | * | 9/1958 | Cordaro et al. | 30/30 |
| 3,029,509 | A | * | 4/1962 | Peters | 30/30 |
| 3,192,934 | A | * | 7/1965 | Catania | 132/136 |
| 3,536,080 | A | * | 10/1970 | Legan et al. | 132/213.1 |
| 3,570,121 | A | * | 3/1971 | Graceffo | 30/30 |
| 3,805,381 | A | * | 4/1974 | Broussard, Sr. | 30/30 |
| 3,914,866 | A | * | 10/1975 | Applegate | 30/233.5 |
| 4,009,725 | A | * | 3/1977 | Stuart | 132/104 |
| 4,401,129 | A | * | 8/1983 | Luque | 132/213.1 |
| 5,259,114 | A | * | 11/1993 | Shorter | 30/131 |
| 5,272,782 | A | * | 12/1993 | Hutt | 15/105 |
| 5,566,687 | A | * | 10/1996 | Trapanovski | 132/148 |
| 7,200,885 | B1 | * | 4/2007 | Thomas | 7/158 |
| 7,284,557 | B1 | * | 10/2007 | Williams | 132/212 |
| 7,849,603 | B2 | * | 12/2010 | Venzon | 30/233.5 |
| 8,707,968 | B2 | * | 4/2014 | Gardner | 132/200 |
| 8,746,257 | B1 | * | 6/2014 | Holmes | 132/148 |
| 2005/0155618 | A1 | * | 7/2005 | Lafferty | 132/104 |
| 2008/0201962 | A1 | * | 8/2008 | Sugawara | 30/233.5 |
| 2009/0000127 | A1 | * | 1/2009 | Smith | 30/134 |
| 2009/0044411 | A1 | * | 2/2009 | Cotant | 30/233.5 |

OTHER PUBLICATIONS http://www.aliexpress.com/item/comb-with-seam-ripper/312105648.html (no date).* http://www.armoryblog.com/gear/tactical-titanium-pocket-comb/ (Aug. 2013).*

* cited by examiner

APPARATUSES, METHODS AND SYSTEMS FOR REMOVING ELASTIC BANDS FROM HAIR

CROSS-REFERENCE TO RELATED APPLICATION

A claim for priority to, and the benefit of, the Jun. 7, 2012 filing date of U.S. Provisional Patent Application No. 61/656,864, titled "Comb with Cutter for Removing Elastic Bands from Hair," ("the '864 Provisional Patent Application") is hereby made pursuant to 35 U.S.C. §119(e). The entire disclosure of the '864 Provisional Patent Application is, by this reference, incorporated herein.

TECHNICAL FIELD

This disclosure relates generally to apparatuses for use in grooming an individual's hair and, more specifically, to apparatuses with features for removing elastic bands and other elastic elements or elongated elements from an individual's hair, as well as to methods for removing elastic bands other elastic elements or elongated elements from an individual's hair.

RELATED ART

Elastic bands, which are often referred to as "rubber bands," have long been used in grooming. Typically, a portion of an individual's hair is gathered (e.g., into a ponytail or pig tail, at the end of a braid, etc.), and an elastic band is placed over the gathered hair, often at a location near the individual's scalp. Placement of the elastic band typically includes stretching the elastic band to expand an opening therethrough, placing the elastic band over the gathered hair and moving it to a desired location over the gathered hair, and repeatedly twisting the elastic band to decrease the size of the opening and pulling the gathered hair through the smaller opening until the elastic band holds the gathered hair in a desired manner.

When an elastic band has been placed in a way that enables it to remain in place for prolonged periods of time and throughout any of a variety of activities (e.g., exercise, sleep, typical daily activities, etc.), it is often difficult to remove from the individual's hair. Removal of an elastic band from hair usually involves rolling the elastic band along a length of the individual's hair. This process typically pulls strands of the hair from the individual's head, which can be painful and have a detrimental effect on how the individual's hair looks.

Combs have been used to groom hair since ancient times. A variety of different types of combs have been developed for different hair types and for different purposes. Typically, a comb includes a spine, or back, and a plurality of spaced apart teeth. The teeth of a comb are usually oriented parallel or substantially parallel to one another. In some combs, all of the teeth have the same or substantially the same configuration, while other combs include teeth with different configurations (e.g., a series of closely spaced fine teeth and an adjacent series of farther spaced rough teeth, etc.).

SUMMARY

In various aspects and embodiments, this disclosure relates to apparatuses that are configured to facilitate the quick and painless removal of elastic bands other elastic elements or elongated elements from an individual's hair, as well as to methods for removing elastic bands and other elastic elements or elongated elements from an individual's hair, or from hair or fur of animals, toys, etc. For the sake of simplicity, the term "elastic bands" is used hereinafter to refer to any of the following: elastic bands, other elastic elements and other elongated elements. Also for the sake of simplicity, the term "hair," as used herein, encompasses natural hair, synthetic hair (e.g., hair of an inexpensive wig, hair on dolls or other toys, etc.) and natural and synthetic fur.

In some embodiments, an apparatus for removing an elastic band from hair comprises an elongated element with a handle and a cutting element. The handle may be configured to be held by an individual's hand and, thus, to enable the individual to manipulate the apparatus. The cutting element may include a grasping element, a protective element and a severing edge. The grasping element and the protective element may protrude in directions that are somewhat parallel to a length of the handle, and may diverge from one another to enable at least a portion of an elastic band to be received therebetween. The severing edge is located between the grasping element and the protective element, at a location where the grasping element and the protective element diverge from one another. The protective element may be configured to prevent inadvertent contact (e.g., of an individual's fingers, etc.) with the severing edge. The grasping element may be tapered or otherwise configured to enable it to grasp a portion of an elastic element and to guide that portion of the elastic element toward the severing edge. The severing edge is configured and oriented to cut or break the elastic element as the portion of the elastic element comes into contact with the severing edge and sufficient localized pressure is applied to that portion of the elastic element by the severing edge.

The apparatus for removing an elastic band from hair may comprise a comb for use in grooming hair. A comb that incorporates teachings from this disclosure includes a spine, teeth and a cutting element. The teeth extend from a front edge of the spine in substantially the same direction as one another, and may be configured and spaced apart in such a way as to facilitate grooming in a conventional manner (i.e., combing of one's hair). The cutting element may be associated with the back edge of the spine. In a specific embodiment, the cutting element comprises a grasping element that protrudes from the spine and that may extend somewhat parallel to a length of the spine. The grasping element may be spaced apart from the spine to define a receptacle. A tip at an end of the grasping element may be relatively small, enabling it to be positioned through at least a portion of an opening of an elastic band through which an individual's hair extends, facilitating placement of a portion of the elastic band into the receptacle of the cutting element. An inner portion (e.g., end, edge, etc.) of the receptacle may comprise a severing edge (e.g., a blade, a sharpened plastic edge, a hardened plastic edge, etc.) that will engage a portion of the elastic band positioned within the receptacle.

In another aspect, a method for removing an elastic band from an individual's hair is disclosed. Such a method includes positioning a tip of a grasping element (e.g., a grasping element that protrudes from a handle, a grasping element that protrudes from a spine of a comb, etc.) at least partially between an elastic band in hair and the hair (e.g., through an opening in the elastic band, which may appear as the grasping element is used to manipulate the elastic band, etc.). With the tip of the grasping element positioned in this manner, the apparatus may be moved in a longitudinal direction (i.e., roughly along its length), further inserting the grasping element between the elastic element and the hair (e.g., into the opening of the elastic element, etc.). At the same time, movement of the apparatus relative to the elastic band causes the elastic band to engage a severing edge associated with a receptacle defined between the grasping element and a protective element of the apparatus (e.g., the spine of the comb, etc.). The severing edge may slice the elastic band or exert sufficient localized pressure on the elastic band to sever or break the elastic band, enabling its removal without any significant hair pulling, damage to the hair, pain to the individual or animal. With the elastic band removed, in embodiments where the apparatus comprises a comb, the comb may then be used to groom the hair.

According to another aspect, an elastic band removal apparatus may be packaged with elastic bands. More specifically, a package may be configured to contain (and, optionally, contain) a plurality of elastic bands and an elastic band removal apparatus.

Other aspects, as well as features and advantages of various aspects, of the disclosed subject matter will become apparent to those of ordinary skill in the art through consideration of the ensuing description, the accompanying drawings and the appended claims.

BRIEF DESCRIPTION OF THE DRAWINGS

In the drawings:

FIGS. 3-7C depict other embodiments of apparatuses for removing elastic bands from hair.

DETAILED DESCRIPTION

Figure 1:
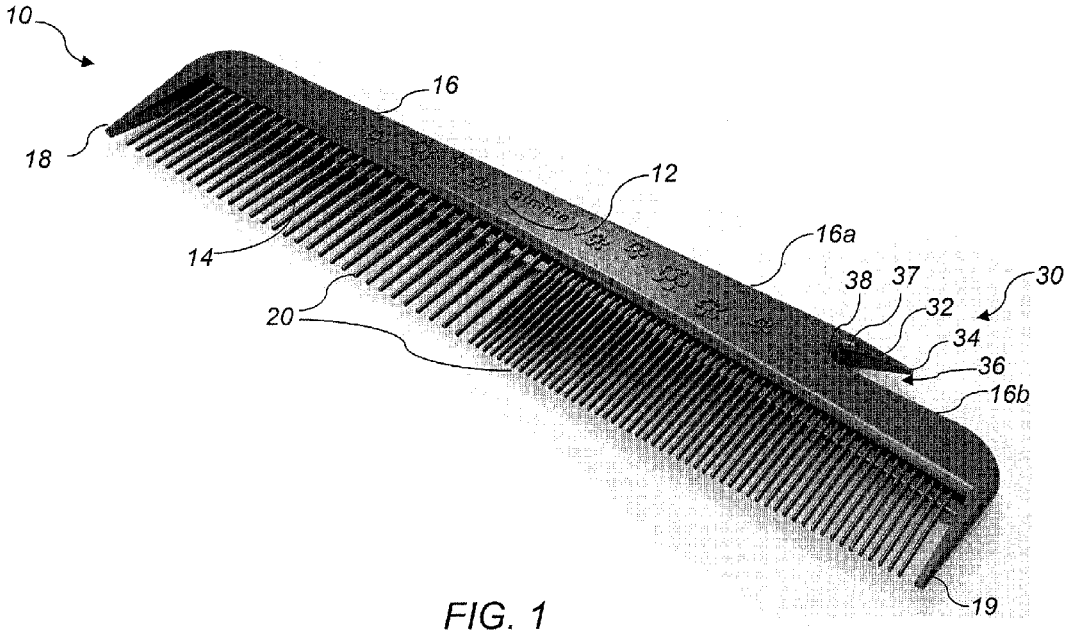
FIG. 1 is a perspective view of an embodiment of an apparatus for removing elastic bands from hair; specifically, a comb with a cutting element.

An embodiment of an apparatus for removing elastic bands according to this disclosure, more specifically, a comb 10, is depicted by FIG. 1. Comb 10 includes a spine 12, ends 18 and 19, teeth 20 and a cutting element 30. The spine 12 of the comb 10 includes a front edge 14 and an opposite back edge 16. The ends 18 and 19 protrude from opposite ends of front edge 14 of the spine 12, substantially perpendicular to a length of the spine 12, and in substantially the same direction as one another. The teeth 20 also protrude from the front edge 14 of the spine 12, substantially perpendicular to the length of the spine 12, and in substantially the same direction as one another. The cutting element 30 is associated with (e.g., is secured to, comprises a part of, is otherwise carried by, etc.) the back edge 16 of the spine 12.

In the depicted embodiment, the cutting element 30 comprises part of the spine 12 and is located near an end of the spine 12 and, thus, near an end 19 of the comb 10. The cutting element 30 includes a grasping element 32, a receptacle 36 and a severing edge 38.

The grasping element 32 may be located toward the nearest end 19 of the comb 10, with its tip 34 located nearest to that end 19. In the depicted embodiment, an upper edge of the grasping element 32 is continuous with a portion 16*a* of the back edge 16 of the spine 12 from which the grasping element 32 extends. The remaining portion 16*b* of the back edge 16, which is located at a position along the back edge 16 between the approximate position at which the cutting element 30 originates and the end 19 of the comb 10, is spaced apart from the grasping element 32. The receptacle 36 includes the space between the grasping element 32 and the remaining portion 16*b* of the back edge 16 of the spine 12.

The grasping element 32 may include a relatively small or pointed tip 34 to enable its insertion through a portion of an opening through an elastic band in an individual's hair. In some embodiments, such as that depicted by FIG. 1, the grasping element 32 may be tapered so as to stretch (i.e., exert tensile force on) the elastic element as the elastic element is forced into the receptacle 36 of the cutting element 30. Further tensile force may, of course, be applied to an elastic band by movement of the comb 10.

The receptacle 36 includes a periphery 37 defined by an inner edge of the grasping element 32 and a part of the remaining portion 16*b* of the back edge 16 of the spine 12 from which the grasping element 32 is spaced. In the illustrated embodiment, the receptacle 36 comprises a C-shaped opening. However, other configurations of receptacles 36 (e.g., V-shaped, square-ended, etc.) may also be included on a comb 10 that incorporates teachings of this disclosure.

The periphery 37 of the receptacle 36 may carry a severing edge 38. The severing edge 38 may be configured to facilitate cutting of an elastic band as a portion of the elastic band, under sufficient tension, comes into contact with the severing edge 38. In some embodiments, the severing edge 38 may comprise a tapered edge of the same material as that from which the spine 12 of the comb 10 is made. In other embodiments, the severing edge 38 may comprise a tapered edge of a different material from that of the remainder of the comb 10. The severing edge 38 may be configured to apply localized pressure to a portion of an elastic band to facilitate breakage of that portion of the elastic band. Alternatively, the severing edge 38 may be configured to cut into a portion of an elastic band, which may reduce the tension that may be required to sever the elastic band, along with any tendency for hair pulling as the elastic band is stretched.

Figure 2:
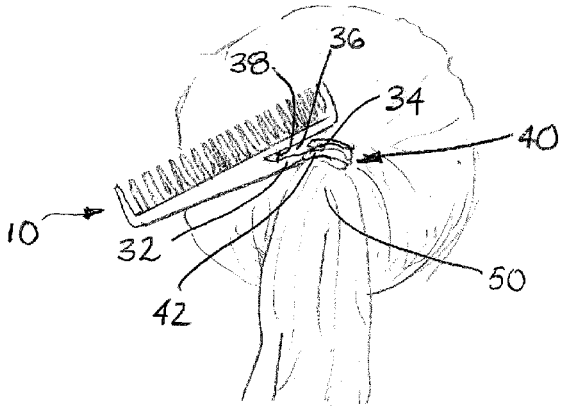
FIG. 2 illustrates use of the comb of FIG. 1 to remove an elastic band from an individual's hair.

Turning now to FIG. 2, and with continued reference to FIG. 1, an embodiment of a method for grooming an individual's hair is illustrated. The tip 34 of a grasping element 32 of a cutting element 30 of a comb 10 may be used to grasp a portion 42 of an elastic band 40 that surrounds gathered strands of an individual's hair 50. More specifically, the tip 34 may be positioned at least partially within an opening 44 defined by the elastic band 40 to position the portion 42 of the elastic band 40 at least partially within a receptacle 36 of the cutting element 30. With the portion 42 of the elastic band 40 in place within the receptacle 36, the comb 10 may be moved in such a way that tension is applied to the portion 42 of the elastic band 40 and that portion 42 is forced against a severing edge 38 within the receptacle 36. As the portion 42 of the elastic band 40 comes into contact with the severing edge 38 under sufficient tension, the severing edge 38 may sever and/or break that portion 42. The elastic band 40 may then be removed from the individual's hair 50 without the conventionally required sliding and/or rolling and, therefore, without any significant hair pulling. The comb 10 may then be used to comb the individual's hair 50.

Figure 3:
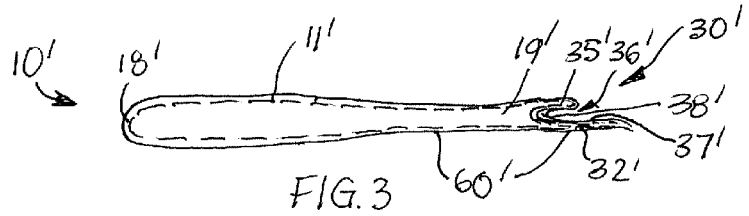

FIG. 3 illustrates another embodiment of elastic band removal apparatus 10'. Elastic band removal apparatus 10' includes a handle 11'. The handle 11' is an elongated element that may be configured to be grasped by an individual's, or user's, hand; for example, to enable manipulation of the elastic band removal apparatus 10'. In the embodiment depicted by FIG. 3, the handle 11' includes a back end 18' and a front end 19' opposite from the back end 18'.

At the front end 19' of the handle 11', the elastic band removal apparatus 10' includes a cutting element 30'. The cutting element 30' includes a grasping element 32' and a protective element 35' that protrude from the front end 19' of the handle 11'. The grasping element 32' and the protective element 35', which are spaced apart from each other to define a receptacle 36', may be oriented in such a way that they diverge from one another. In addition to the grasping element 32', the protective element 35' and the receptacle 36', the cutting element 30' includes a severing edge 38', which may be exposed beyond at least a portion of a periphery 37' of the receptacle 36' (e.g., at a junction between the grasping element 32' and the protective element 35', etc.).

In the embodiment illustrated by FIG. 3, the severing edge 38' and, optionally, one or more other features (e.g., the grasping element 32', the protective element 35', an interior portion of the handle 11', etc.) may be formed from metal or another hard material that could scratch, cut or pierce skin or otherwise cause damage. In embodiments where features other than the severing edge 38' are formed from a material that has the potential to cause damage, a sheath 60' may be provided. The sheath 60', which may comprise a material that is less likely to cause damage (e.g., a softer material, etc.) but will still enable the elastic band removal apparatus 10' to function as intended, may be configured to be positioned over, but substantially retain, the shapes of one or more features of the elastic band removal apparatus 10', such as the grasping element 32' of the cutting element 30'.

Figure 4:
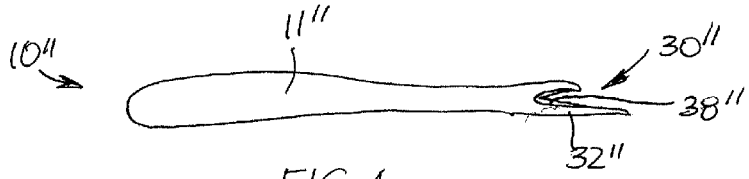

FIG. 4 shows an embodiment of an elastic band removal apparatus 10" that is similar to the elastic band removal apparatus 10' shown in FIG. 3, but lacks a sheath. Instead, the grasping element 32" of the cutting element 30" of the elastic band removal apparatus 10" is (and, optionally, one or more other features of the elastic band removal apparatus 10" are) formed from a relatively soft material (e.g., a rubber-coated plastic, a relatively soft plastic, etc.), or a material that is unlikely to cause damage during use of the elastic band removal apparatus 10". In contrast, the severing edge 38" of the cutting element 30" of the elastic band removal apparatus 10" may comprise a harder material (e.g., metal, harder plastic, hardened plastic (e.g., a hardened version of the plastic from which the grasping element 32" is formed, etc.), etc.) that will enable and/or facilitate cutting or breakage of an elastic band.

Figure 5:
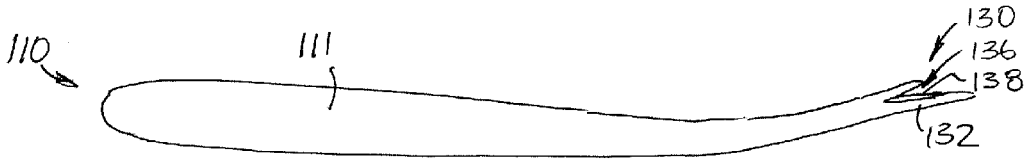
Figure 6:
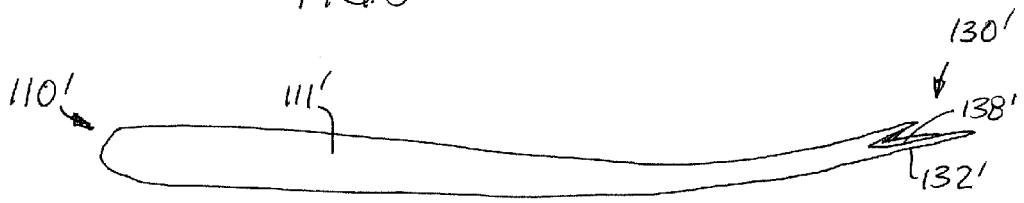

The embodiments of elastic band removal apparatuses 110 and 110' illustrated by FIGS. 5 and 6, respectively, include handles 111 and 111' that are longer than the handles 11 and 11" of the elastic band removal apparatuses 10' and 10" shown in FIGS. 3 and 4, respectively. A longer handle 111, 111' may be easier for an individual to grasp and, thus, may enable more controlled manipulation of the elastic band removal apparatus 110, 110'. In addition, a longer handle 111, 111' may be curved or otherwise bent in a manner that orients the cutting element 130, 130', or at least the grasping element 132, 132' thereof, non-parallel to the handle 111, 111'. Such an orientation may be configured to improve the ability of the elastic band removal apparatus 110, 110' to grasp a portion of an elastic band and to remove (e.g., cut, break, etc.) the elastic band from hair.

In the embodiment depicted by FIG. 5, the cutting element 130 of the elastic band removal apparatus 110 includes a single severing edge 138 oriented along at least a portion of an interior edge of the grasping element 132 (i.e., an edge that defines the receptacle 136). Alternatively, as shown in FIG. 6, another embodiment of elastic band removal apparatus 110' may include a severing edge 138' with two elements that converge (e.g., like a "V", a "U", etc.) (which elements may comprise part of a single member, or may be separate elements that have been assembled with each other).

Figures 7A, 7B, 7C:
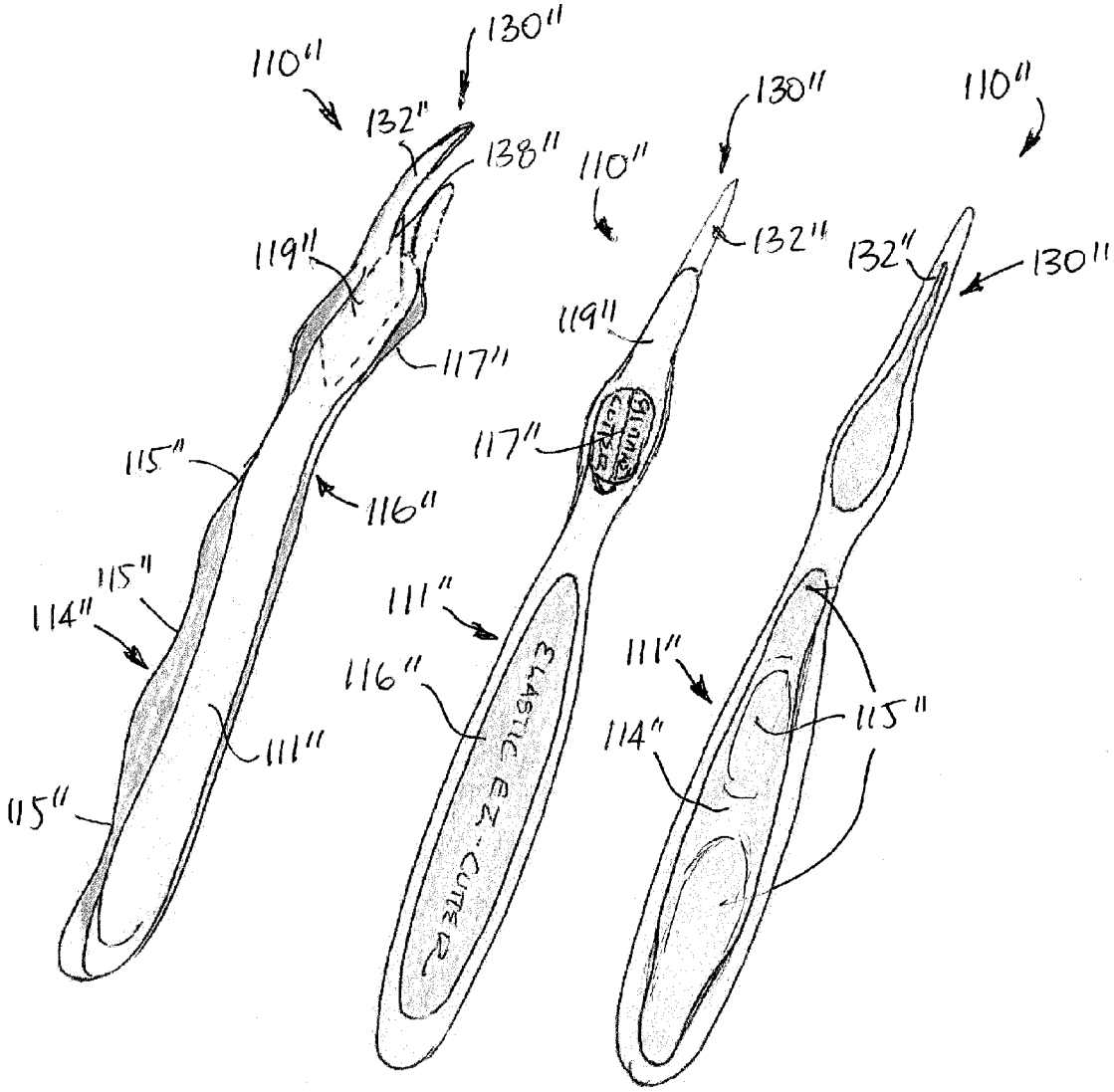

FIGS. 7A-7C depict an embodiment of an elastic band removal apparatus 110" that includes a handle 111" with features that are configured to receive various phalanges of an individual's hand. As illustrated, a bottom surface 114" of the handle 111" may be configured to receive fingers of an individual's hand. More specifically, as shown in FIGS. 7A and 7C, the bottom surface 114" of the handle 111" may include one or more depressions 115" for receiving fingers of the individual's hand. An opposite, top surface 116" of the handle 111" may be configured to receive an individual's thumb. More specifically, the top surface 116" of the handle 111", near its front end 119", and, thus, the cutting element 130" of the elastic band removal apparatus 110" may include a feature 117" for receiving the thumb, such as the thumb rest depicted in FIGS. 7A and 7B. In some embodiments, these features may be formed from or lined with a material that is comfortable to grip, such as a conformable or cushioning material (e.g., a silicone, etc.).

The elastic band removal apparatuses 10', 10", 110, 110' and 110" depicted in FIGS. 3, 4, 5, 6 and 7A-7C, respectively, as well as other embodiments of elastic band removal apparatuses that fall within the broad scope of the disclosed subject matter, may be used in a manner similar to the use of the comb 10, as depicted in FIG. 2, to remove an elastic band from hair. Thus, by manipulating the handles 11', 11", 111, 111', 111" of these elastic band removal apparatuses 10', 10", 110, 110', 110", respectively, the grasping elements 32', 32", 132, 132', 132" of these elastic band removal apparatuses 10', 10", 110, 110', 110" may be used to grasp a portion 42 of an elastic band 40, to bring the portion 42 of the elastic band 40 into contact with the severing edges 38', 38", 138, 138', 138" that correspond to the grasping elements 32', 32", 132, 132', 132", and to cut or break that portion 42 of the elastic element 40.

Figure 8:
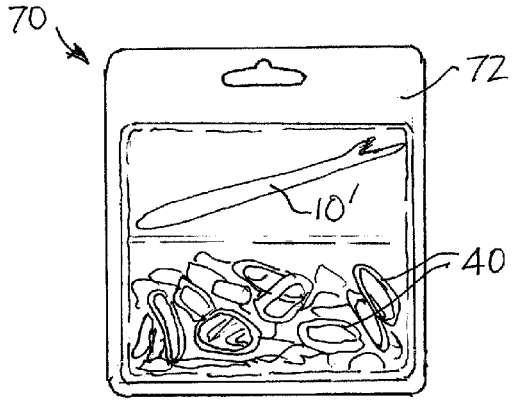
FIG. 8 depicts an embodiment of a package that holds elastic bands and an elastic band removal apparatus.

Turning now to FIG. 8, an elastic band removal apparatus 10' (or any other embodiment of elastic band removal apparatus, including a comb, such as that depicted by FIG. 1) may be packaged in a grooming kit 70 with one or more elastic bands 40. As shown, the grooming kit 70 may include a package 72, which may be configured to contain or otherwise carry one or more elastic bands 40 and the elastic band removal apparatus 10. Thus, the elastic band removal apparatus 10 may be sold with elastic bands 40, providing a grooming kit 70 that enables the use of elastic bands 40 for grooming hair in a desired fashion, as well as the removal of elastic bands 40 from the hair once their use is no longer desired.

The disclosed embodiments should not be deemed to limit the scope of any of the claims that follow. The scope of each claim should be limited merely by its plain language, and should be deemed to include the full complement of available equivalents.

What is claimed:

1. A comb for grooming hair, comprising:

a spine including a front edge and a back edge;

a plurality of teeth protruding from the front edge of the spine; and a cutting element, comprising:

a fixed grasping element protruding from the back edge of the spine, the fixed grasping element including an inner edge that faces the back edge of the spine;

an intermediate edge continuous with the back edge of the spine and the inner edge of the fixed grasping element;

a receptacle defined by the back edge of the spine, the intermediate edge and the inner edge of the fixed grasping element; and a single fixed blade carried by the back edge of the spine and the intermediate edge, the single fixed blade including a portion located above the back edge of the spine and oriented transverse to an orientation of the back edge of the spine, the cutting element configured to engage and cut an elastic band in hair.

2. The comb of claim 1, wherein the single fixed blade is configured to cut through the elastic band.

3. The comb of claim 1, wherein the single fixed blade is configured to apply a localized force to the elastic band.

4. The comb of claim 1, wherein the single cutting element comprises a same material as the spine.

5. The comb of claim 1, wherein the single cutting element comprises a different material from the spine.

6. The comb of claim 1, wherein the fixed grasping element is configured to direct a portion of the elastic band into the receptacle.

7. The comb of claim 1, wherein the fixed grasping element is oriented substantially parallel to the spine.

8. The comb of claim 1, wherein the fixed grasping element is located near an end of the comb and extends toward the end of the comb.

9. The comb of claim 1, wherein the cutting element is located near an end of the comb.

10. A comb for grooming hair, comprising:

a spine including a front edge and a back edge;

a plurality of teeth protruding from the front edge of the spine; and a cutting element defined by a portion of the back edge of the spine, the cutting element including:

a grasping element protruding from the back edge of the spine and including a grasping portion spaced apart from the back edge of the spine and extending in generally a same direction as the back edge of the spine;

a receptacle defined by the back edge of the of the spine and the fixed grasping element; and a fixed cutting edge at a closed end of the receptacle, the cutting element configured to engage and cut an elastic band in hair.

11. The comb of claim 10, wherein the fixed cutting edge comprises a same material as the spine.

12. The comb of claim 10, wherein the fixed cutting edge comprises a different material from the spine.

13. The comb of claim 10, wherein the grasping element is configured to direct a portion of the elastic band into the receptacle.

14. The comb of claim 10, wherein the grasping element is oriented substantially parallel to the spine.

15. The comb of claim 10, wherein the grasping element is located near an end of the comb and extends toward the end of the comb.

16. The comb claim 10, wherein the cutting element is located near an end of the comb.

17. A comb for grooming hair, comprising:

a spine including a front edge and a back edge;

a plurality of teeth protruding from the front edge of the spine; and a cutting element at least partially defined by the back edge of the spine, the cutting element including:

a fixed grasping element protruding from the back edge of the spine;

a peripheral edge defined by spaced locations of the fixed grasping element and the back edge of the spine that are located opposite from one another and by a continuous edge connecting the locations of the fixed grasping element and the back edge of the spine that are located opposite from one another;

a receptacle defined by the peripheral edge; and a fixed cutting edge within the receptacle, along at least a portion of the peripheral edge.

18. The comb of claim 17, wherein the fixed cutting edge comprises a same material as the spine.

19. The comb of claim 17, wherein the fixed cutting edge comprises a different material from the spine.

* * * * *